US007337731B2

(12) United States Patent
Mu et al.

(10) Patent No.: US 7,337,731 B2
(45) Date of Patent: Mar. 4, 2008

(54) CONJOINED FOLDING TABLE

(75) Inventors: Jiawei Mu, Changzhou (CN); Shudong Wang, Changzhou (CN)

(73) Assignee: Changzhou Qiaoyu Group Co., Ltd., Jiangsu (CN)

( * ) Notice: Subject to any disclaimer, the term of this patent is extended or adjusted under 35 U.S.C. 154(b) by 469 days.

(21) Appl. No.: 11/022,223

(22) Filed: Dec. 23, 2004

(65) Prior Publication Data

US 2005/0166807 A1 Aug. 4, 2005

(30) Foreign Application Priority Data

Dec. 26, 2003 (CN) ..... 2003 2 0123286

(51) Int. Cl.
*A47B 3/04* (2006.01)

(52) U.S. Cl. ..... 108/132; 108/67; 108/36

(58) Field of Classification Search ..... 108/132, 108/67, 115, 118, 130, 131, 34, 35, 36; 248/188.1, 248/188.6
See application file for complete search history.

(56) References Cited

U.S. PATENT DOCUMENTS 1,295,194 A * 2/1919 Parelius ..... 108/34
1,960,181 A * 5/1934 Dreier ..... 108/132
2,535,921 A * 12/1950 Hart ..... 108/155
4,191,111 A * 3/1980 Emmert ..... 108/132
6,792,880 B2 * 9/2004 Tsai ..... 108/115
6,874,427 B2 * 4/2005 Izumi ..... 108/34
7,011,364 B2 * 3/2006 Meskill et al. ..... 297/158.4
7,055,563 B2 * 6/2006 Logan ..... 144/286.5
2002/0139282 A1 * 10/2002 Liu ..... 108/131

* cited by examiner

*Primary Examiner*—Janet M. Wilkens
*Assistant Examiner*—Mark K Kuhn
(74) *Attorney, Agent, or Firm*—Martine Penilla & Gencarella, LLP

(57) ABSTRACT

A conjoined folding table includes a table plane and plane support frames, wherein under the table plane are disposed two groups of identical support frames. Each group of plane support frames includes two support legs, two slide support rods, a slide block, two slant support rods, a pull rod, a stay bar, two plane support traverse tubes, a pivotal member, and a U-shaped hinge. The slide support rod is connected to the support leg via a slide block, and the upper end of the slide support rod is movably hinged with the plane support traverse tube. The lower ends of the two slide support rods are rotatably connected via a rotary member, or one end of slide support rod is connected to the support leg via a slide block, and the other end is connected to the plane support traverse via a slide block and is provided with a cross support rod.

9 Claims, 10 Drawing Sheets

CONJOINED FOLDING TABLE

FIELD OF THE INVENTION

This invention relates to a conjoined folding table that is suitable for travel and outdoor activities, leisure in a courtyard, in a park, and at the beach.

BACKGROUND OF THE INVENTION

At present, the folding table available on the market is not convenient to operate, because the table plane and the support frame cannot be unfolded all at once, and the structure is not stable. For an ordinary folding table, the table plane and support frame are usually separated into two parts. When the table is folded, the plane has to be removed first, and then the support frame is folded. When packed, the table has to be separated into two parts. Thus, it is not convenient for packing, transportation and carrying. In addition, the existing folding table is likely to shake due to inhomogeneous forces exerted by the support legs when the table plane is pressed.

SUMMARY OF THE INVENTION

The present invention provides a conjoined folding table that overcomes the above-mentioned defects. The conjoined folding table includes a table plane that is connected to support frames. The table plane is formed of battens, which are easy to fold. The support frames include support legs, slide support rods, slant support rods, a pull rod, pivotal members, and plane support traverse tubes, all of which are convenient for integral support and folding. So, the table has a small volume after being folded, and thus is convenient for packing, transportation, and carrying.

In one embodiment, the conjoined folding table includes a table plane and support frames. Two groups of identical plane support frames are disposed under the table plane. The table plane is comprised of a plurality of battens joined together via linking ropes. Each plane support frame includes two support legs, two slide support rods, two slide blocks, two slant support rods, two pull rods, a stay bar, two plane support traverse tubes, a pivotal member, U-shaped hinges, and a self-locking joint piece. A pivotal member has a pivotal member body and is disposed at the upper portion of each of the two support legs. At one side of the pivotal member body is provided a mount groove, which is connected to the two support legs. At the other side of pivotal member body is provided a tube mount groove. At the upper portion of the pivotal member is provided a mount groove for one of the plane support traverse tubes, and at the upper portion of the tube mount groove of the pivotal member is provided a fixture. One of the slide support rods is connected to one of the support legs via a slide block. The upper end of one of the slide support rods is movably hinged to one of the plane support traverse tubes. The lower ends of the two slide support rods are rotatably connected to the support legs via rotary members, or one end of the slide support rod is connected to the support leg via a slide block, and the other end thereof is connected to the plane support traverse tube via a slide block and is provided with a cross support rod. One end of the cross support rod is mounted on the slide support rod via a slide block, and the other end is connected movably to the slide block. The middle and upper portions of the cross support rod are hinged to the support leg. One end of one of the slant support rods is connected to one of the slide blocks via a U-shaped hinge, and the other end is connected to one of the pull rods via a joint member. At the other end of the pull rod is provided a joint piece for fastening to the table plane. One end of the stay bar is movably connected to the joint member, and the other end is mounted in the tube mount groove. One end of each of the two support traverse tubes is mounted in the mount groove for mounting the support traverse tubes, and the other end is provided with a sealing head and a plane joint member.

In the plane support frame, the two slant support rods, stay bars, and two pull rods form a plurality of triangle support structures via joint members.

The table plane is mounted and fixed on the plane joint members at both ends of the plane support traverse tubes, with the fixtures at the top of the pivotal member and on the upper portion of the fixing piece, thus constituting a fixed connection with the table plane.

The conjoined folding table has a number of advantageous features. First, the folding table is reasonably designed. Second, as the table plane and the plane support frame are assembled into one body, the table is easy for folding and unfolding. Third, since the two slant support rods, the stay bars, and the two pull rods form a plurality of stable triangle support structures via joint members, the folding table is stable. Finally, the folding table is convenient in use, and has a small volume after being folded, is therefore easy to pack, transport, and carry.

BEST MODES OF CARRYING OUT THE INVENTION

Figure 1:
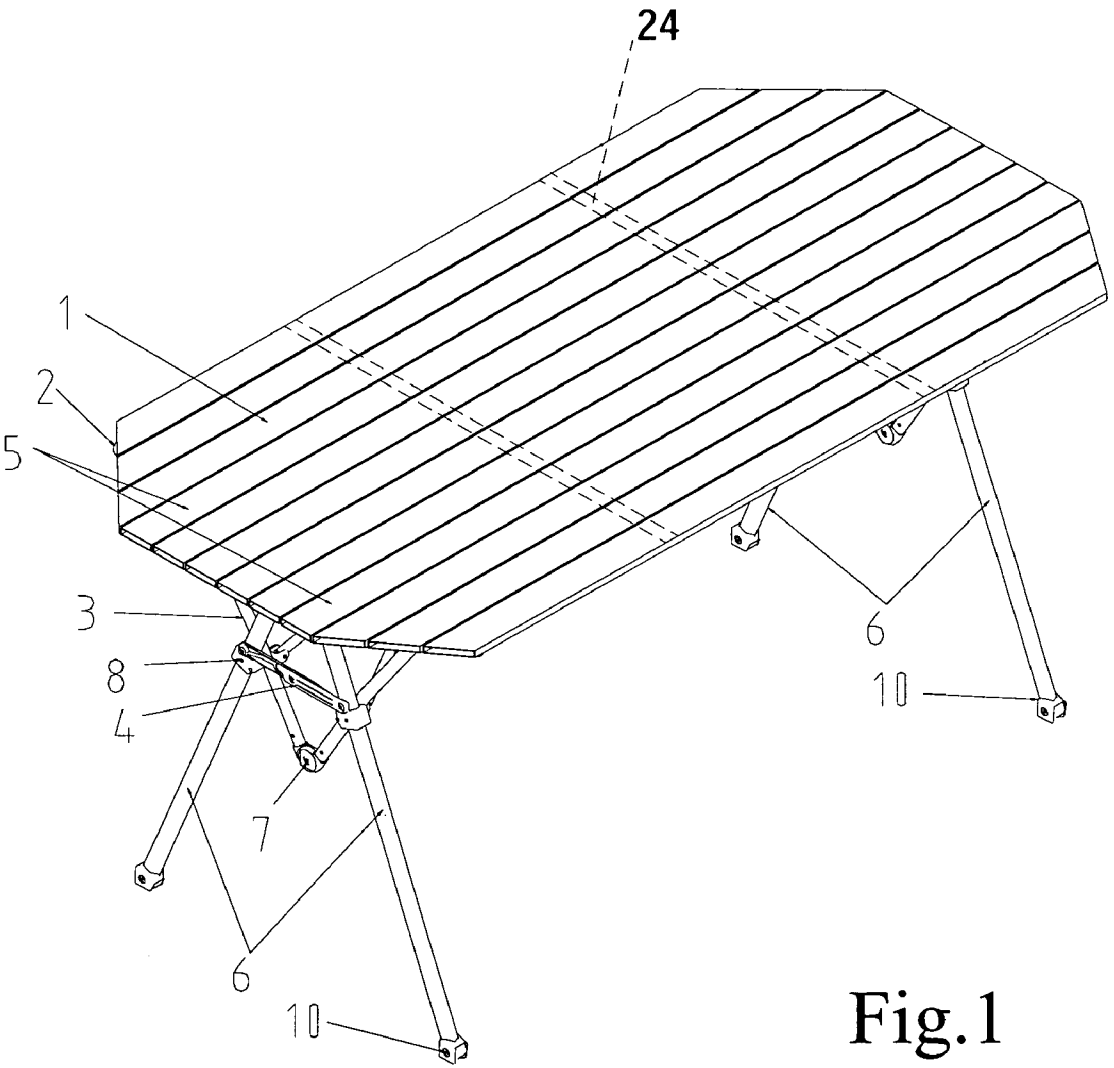
FIG. 1 is a structural view of the conjoined folding table according to one embodiment of this invention.
Figure 1A:
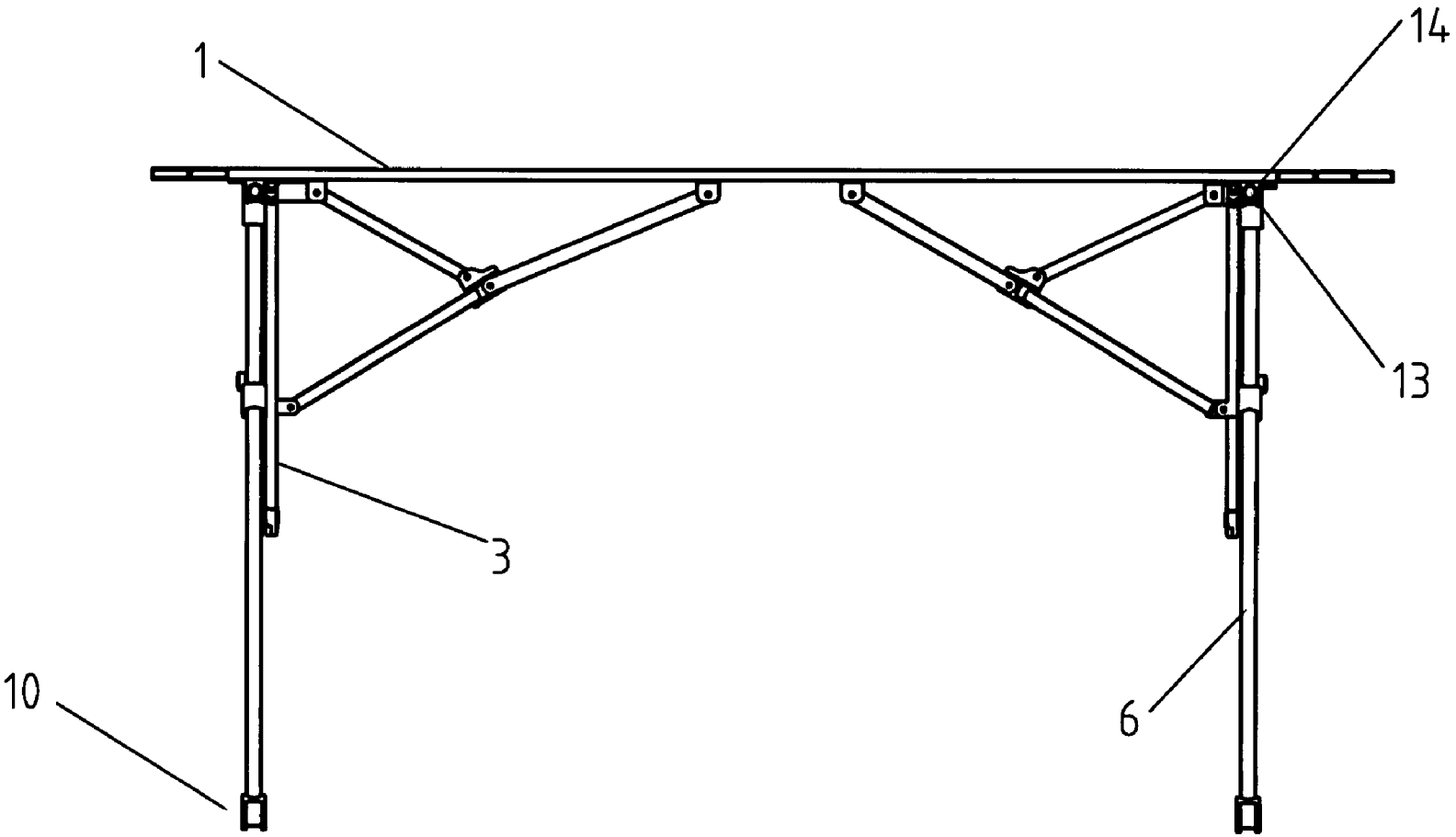
FIG. 1A is a side view of the conjoined folding table according to one embodiment of this invention.

Specific embodiments the folding hanging bed according to embodiments of this invention will be discussed in conjunction with the drawings.

Referring to FIGS. 1-10, the conjoined folding table includes a table plane 1 and a plane support frame, and under the table plane is provided a support frame. Table plane 1 includes a plurality of battens 5 joined together via linking ropes 24. Under the table plane 1 is provided two identical plane support frames, with each plane support frame including two support legs 6, two slide support rods 3, two slide blocks 8, two slant support rods 9, a rod joint member 15, two pull rods 16, a stay bar 17, two plane support traverse tubes 2, a pivotal member 20, and two U-shaped hinges 11. At the upper portions of the two support legs is disposed a pivotal member 20, which has a pivotal member body 201. At the lower portion of the pivotal member body 201 is provided a mount groove 203 for the two support legs 6. At one side of pivotal member body 201 is provided a tube mount groove 204, and at the upper portion of the pivotal member 20 is provided a mount groove for the plane support traverse tube (please refer to FIGS. 4 and 5). At the upper portion of the tube mount groove 204 of the pivotal member is provided a fixture 18, the upper surface of which is connected to the table plane 1. The slide support rod 3 is connected to the support leg 6 via a slide block 8. The upper end of the slide support rod 3 is movably hinged to the plane support traverse tube 2. The lower ends of the two slide support rods 3 are rotatably connected via rotary members 7 (see FIG. 2). One end of each of the two plane support traverse tubes 2 is mounted in the mount groove 202 for the plane support tube, and the other end is provided with a sealing head 13 (see FIG. 8), one end of which is provided an antiskid goffer 131, and is inserted into the end port of the plane support traverse tube 2 and fixed, with the other end of the sealing head being provided with an elastic fastener 132 having an elastic bayonet.

Figure 3:
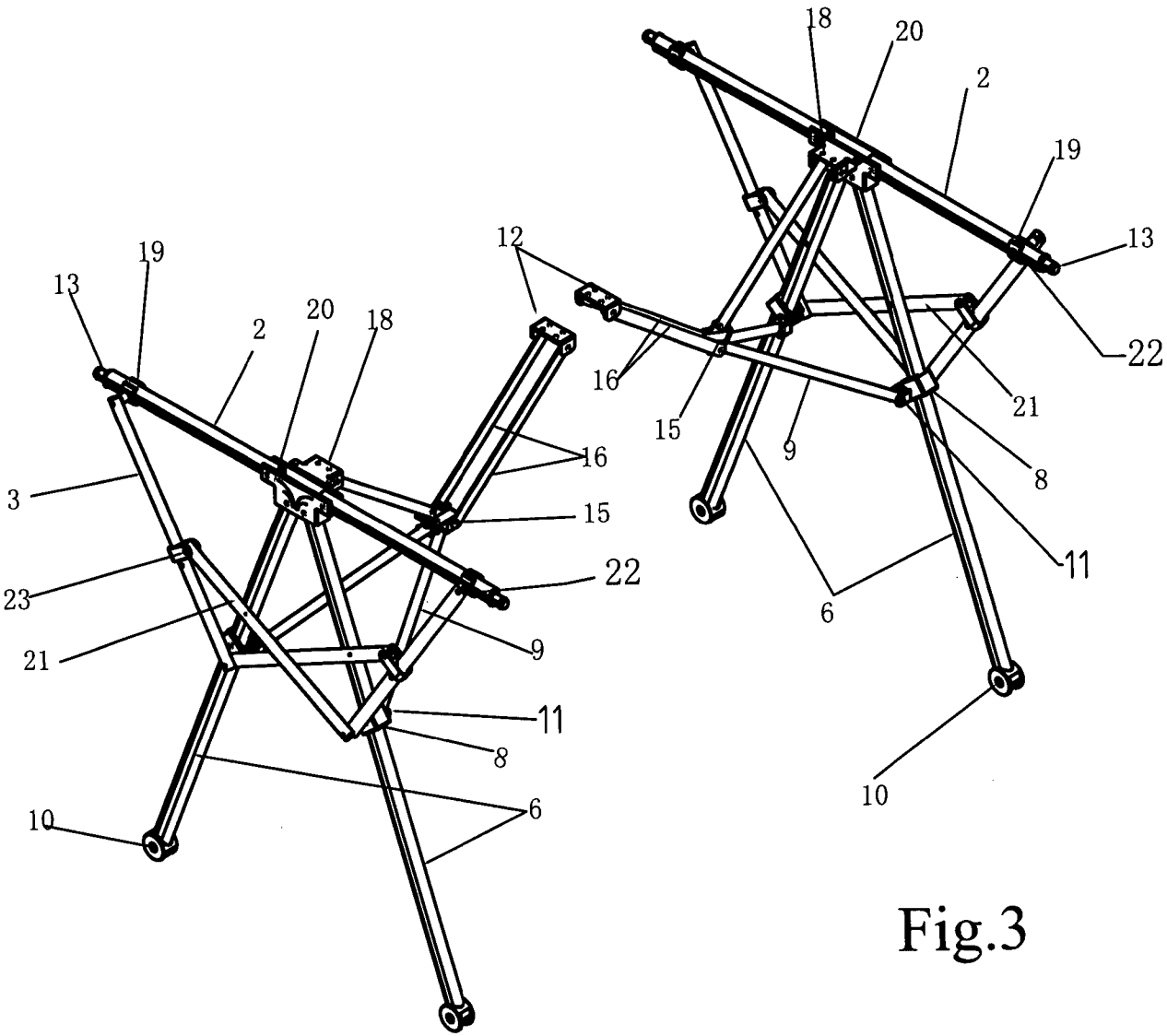
FIG. 3 is another structural view of the support frame of the conjoined folding table according to one embodiment of this invention.
Figure 4:
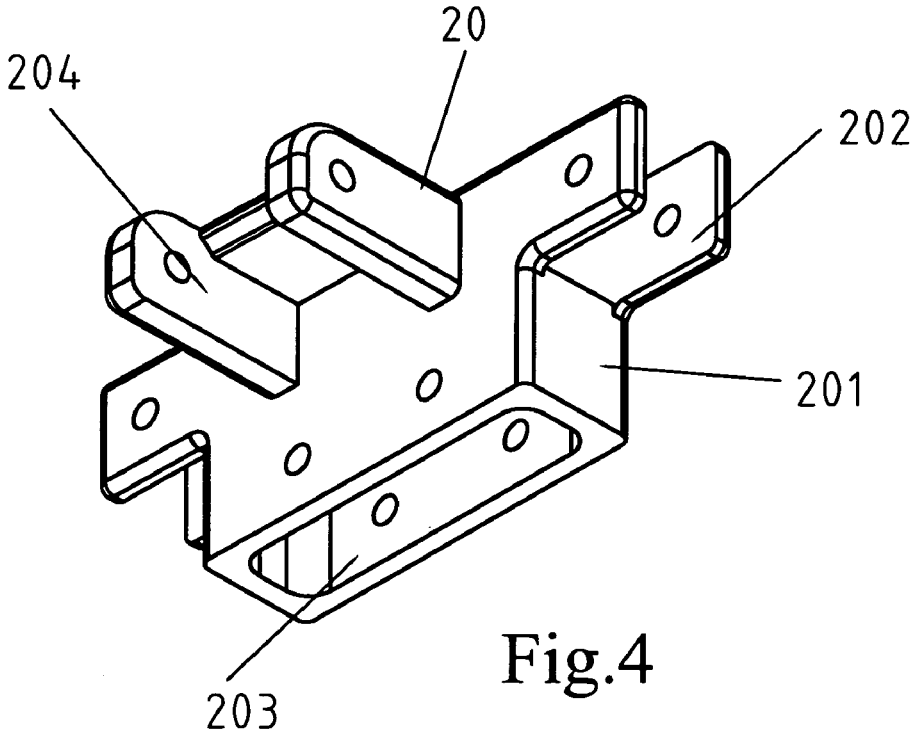
FIG. 4 is a view of the pivotal member of the conjoined folding table according to one embodiment of this invention.
Figure 5:
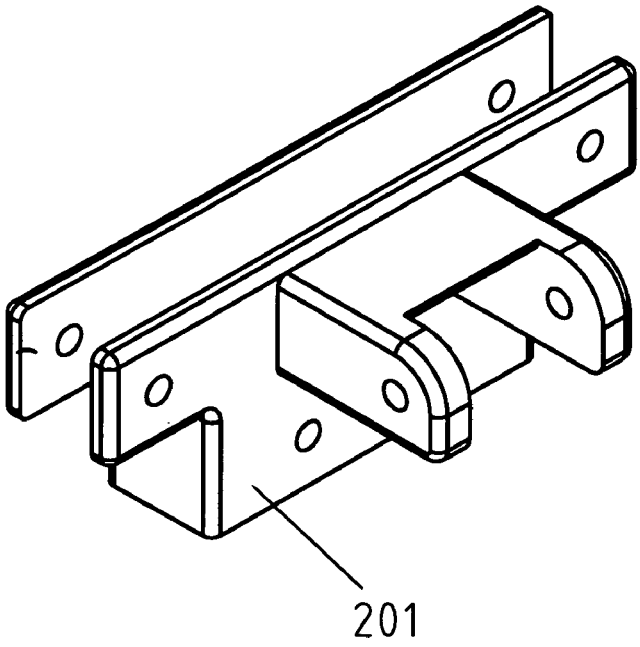
FIG. 5 is a top view of the pivotal member of the conjoined folding table according to one embodiment of this invention.
Figure 6A:
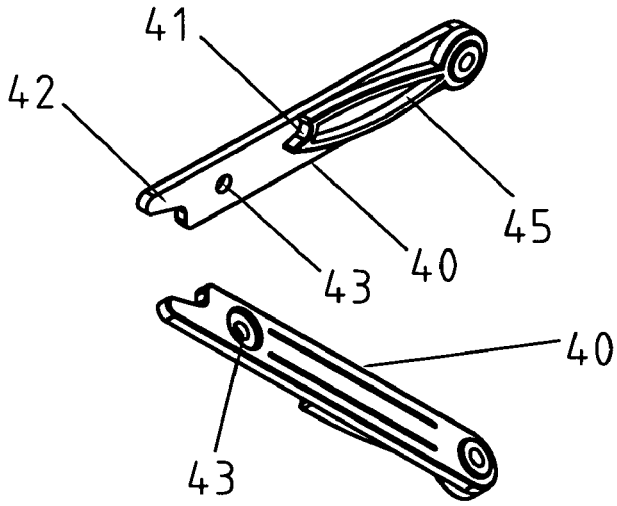
FIGS. 6A-6C are views of the self-lock joint member of the conjoined folding table of this invention in a disassembled state, an assembled state (locked), and an assembled state (bent), respectively.
Figure 6B:
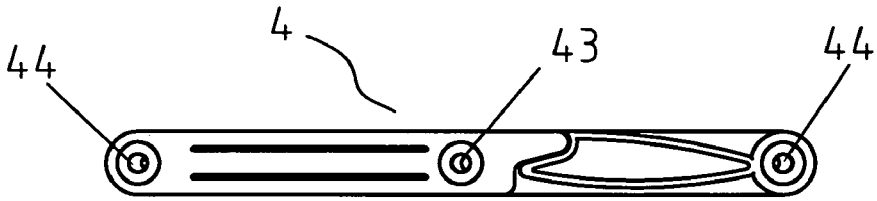
Figure 6C:
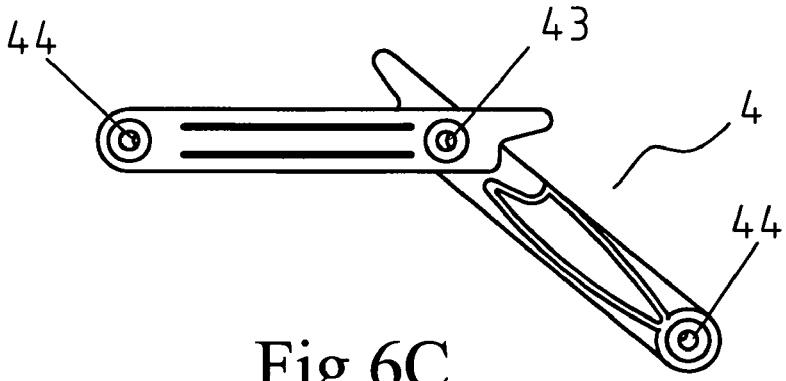
Figure 10:
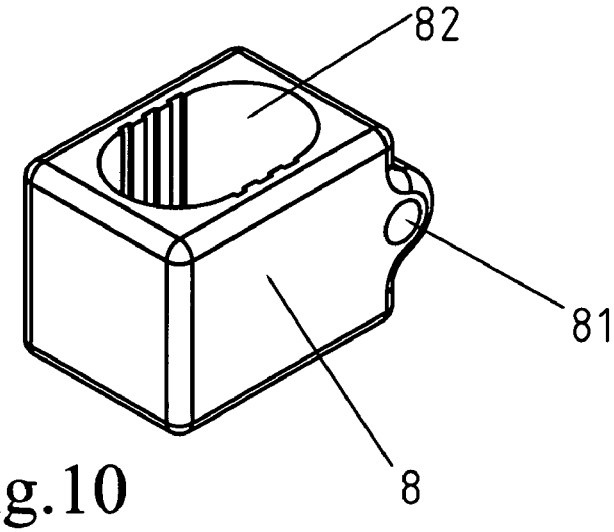
FIG. 10 is a view of the slide block of the conjoined folding table of this invention.
Figure 11:
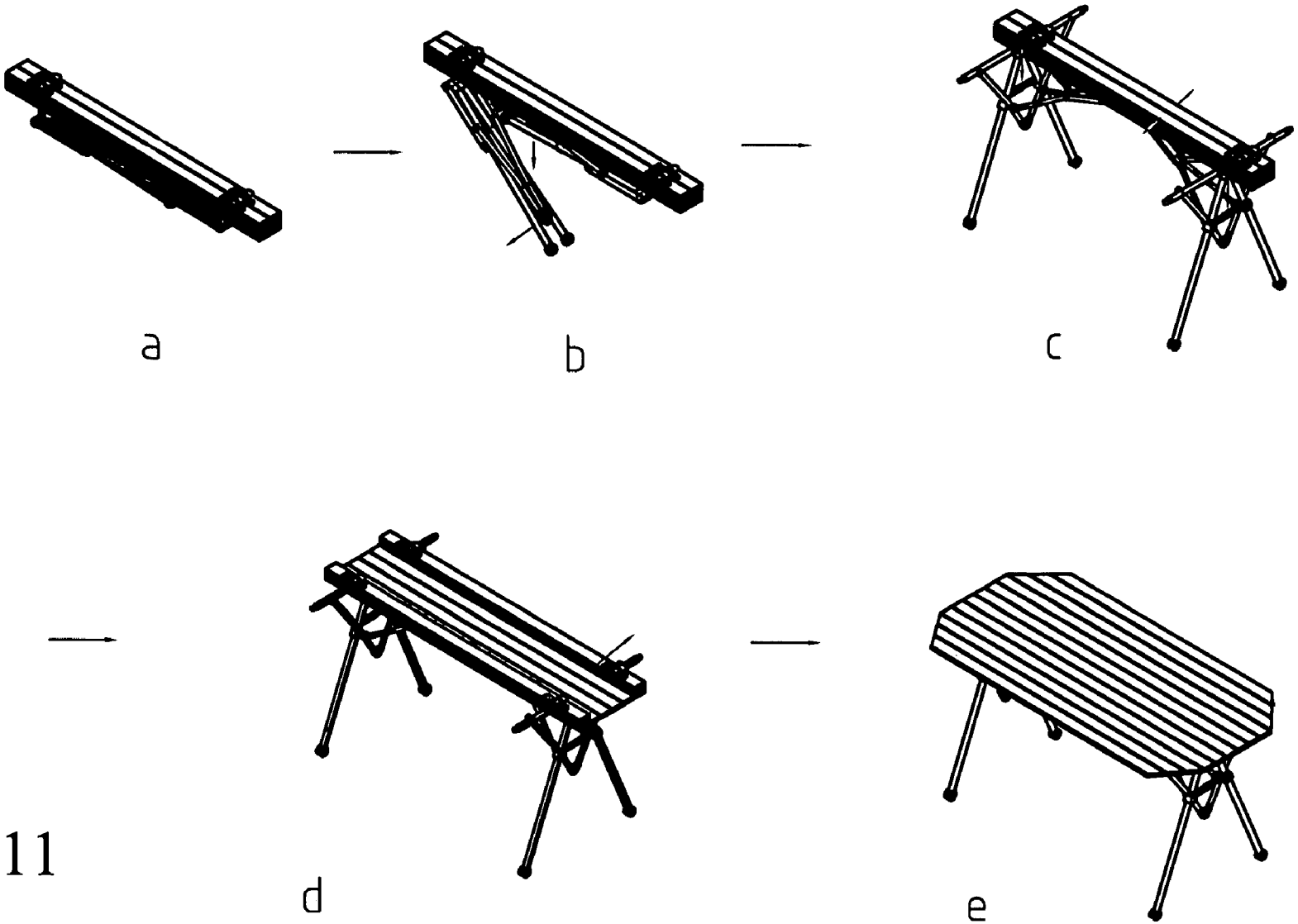
FIGS. 11*a-e* are sequential views from the folding state to the use state of the conjoined folding table according to one embodiment of this invention.

Referring to FIG. 3, one end of the slide support rod 3 may also be connected to one end to the support leg 6 via a slide block 8, with the other end of the slide support rod being connected to the plane support traverse tube 2 via a slide block 19. The slide support rod 3 may be provided with a cross support rod 21, one end of which is sleeved on the slide support rod 3 via a slide block sleeve 23, and the other end of which is connected movably thereto via the connection hole 81 of the slide block 8. Referring to FIG. 10, the middle and upper portions of the cross support rod 21 are hinged to the support legs 6. The end portion of the plane support traverse tube is provided with a sealing head 13, and a hole is provided between the slide block 19 and the sealing head 13, forming a protrusion with a self-plugging rivet as a stopper 22.

Figure 2:
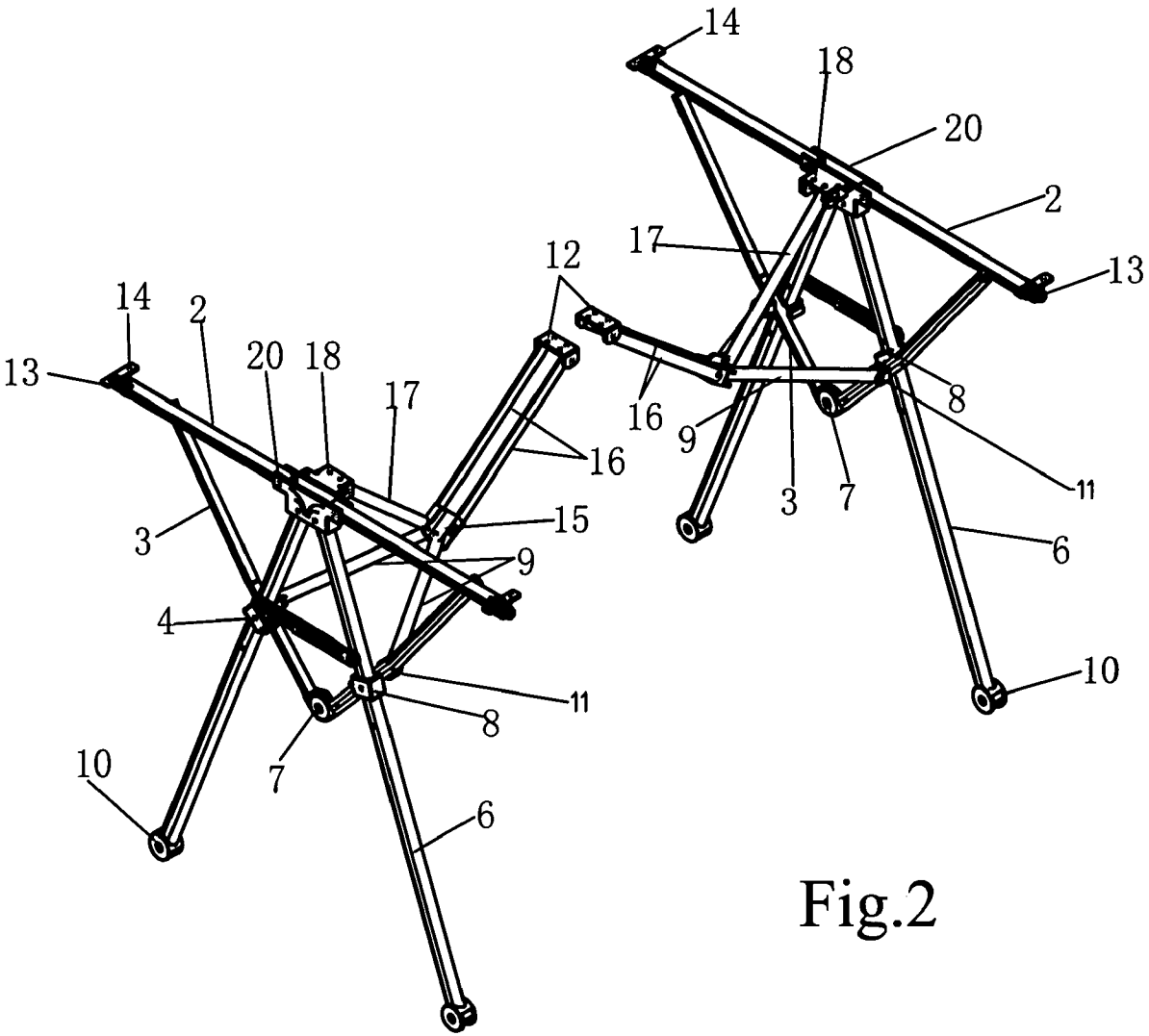
FIG. 2 is a structural view of the support frame of the conjoined folding table according to one embodiment of this invention.

As shown in FIGS. 2 and 3, the bottom of support leg 6 is provided with a shoe 10. One end of the slant support rod 9 is connected to the slide block 8 via a U-shaped hinge 11, and the other end thereof is connected to the pull rod 16 via a rod joint member 15. The other end of the pull rod 16 is disposed with a plane fixing joint piece 12. One end of stay bar 17 is connected movably to a rod joint member 15, and the other end is mounted in the tube mount groove 204 of the pivotal member 20.

Referring now to FIGS. 2, 6A, 6B, and 6C, the support leg 6 may be provided with a self-locking joint member 4, which is assembled into one by two self-locking joint pieces having limiting protrusions 42 and limiting section 45 via hinging hole 43, wherein one side of each self-locking joint piece 40 is provided with a limiting section 45 protruding from the piece body. The limiting section has a limiting groove 41 facing the hinging hole 43, and the limiting groove 41 engages with the limiting protrusion 42 protruding from the outside of the self-locking joint piece hinging hole 43, and the other end of the self-locking joint piece is provided with a mount hole 44 connected to the support leg 6. The two self-locking joint pieces have corresponding arrangements at the side with limiting section 45.

In the plane support frame, two slant support rods 9, stay bar 17, and two pull rods 16 form a plurality of triangle support structures via a rod joint member 15.

The table plane 1 is mounted and fixed on the table plane joint members 14 at both ends of the plane support traverse tubes 2, the fixtures 18 at the top of the pivotal member, and on the upper portion of the fixing piece 12, thus constituting a fixed connection with the table plane 1.

Figure 7A:
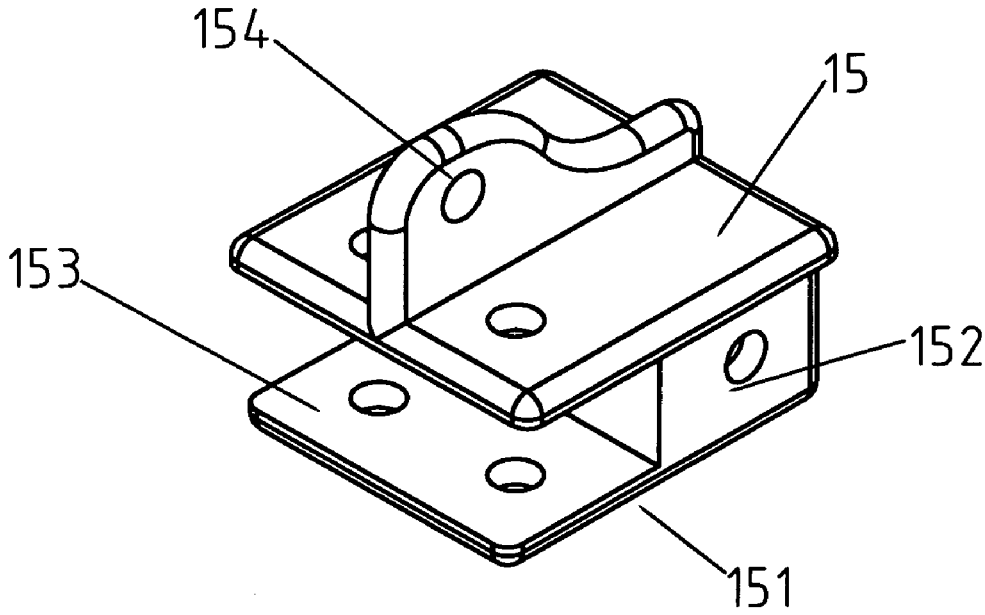
FIGS. 7A and 7B are a top view and a side view, respectively, of the joint member of the conjoined folding table of this invention.
Figure 7B:
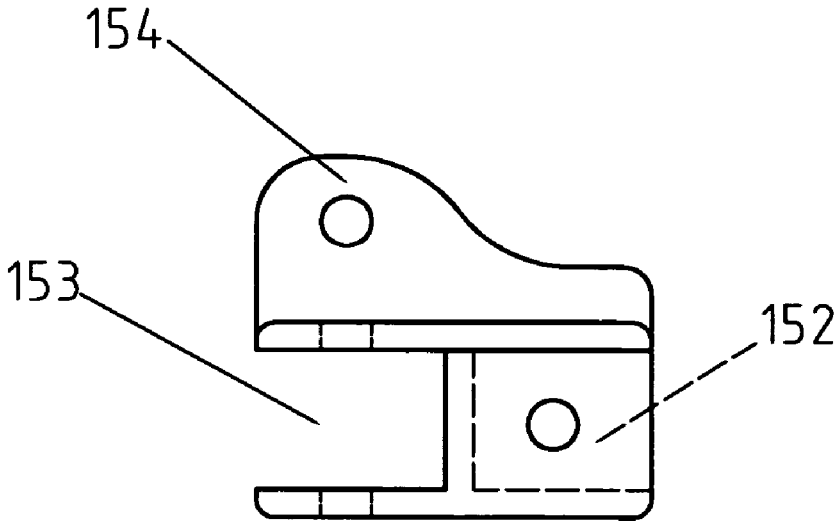
Figure 8:
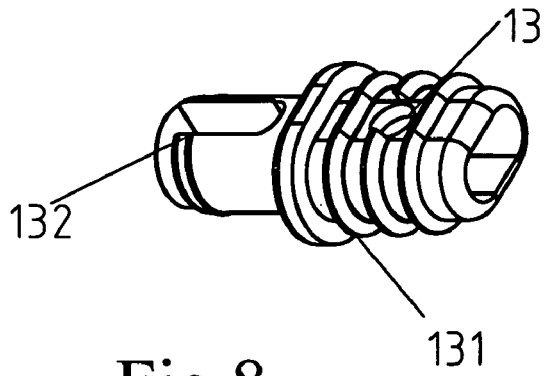
FIG. 8 is a view of the sealing head of the conjoined folding table of this invention.

Referring to FIGS. 7A and 7B, rod joint member 15 has a joint member body 151, which is provided with tube connection groove 153. The two slant support rods 9 are mounted in the tube connection groove 153. At the opposite end to the tube connection groove 153 is provided a pull rod connection groove 152. On the top of the joint member body 151 is provided a stay bar connection protrusion 154.

Figure 1B:
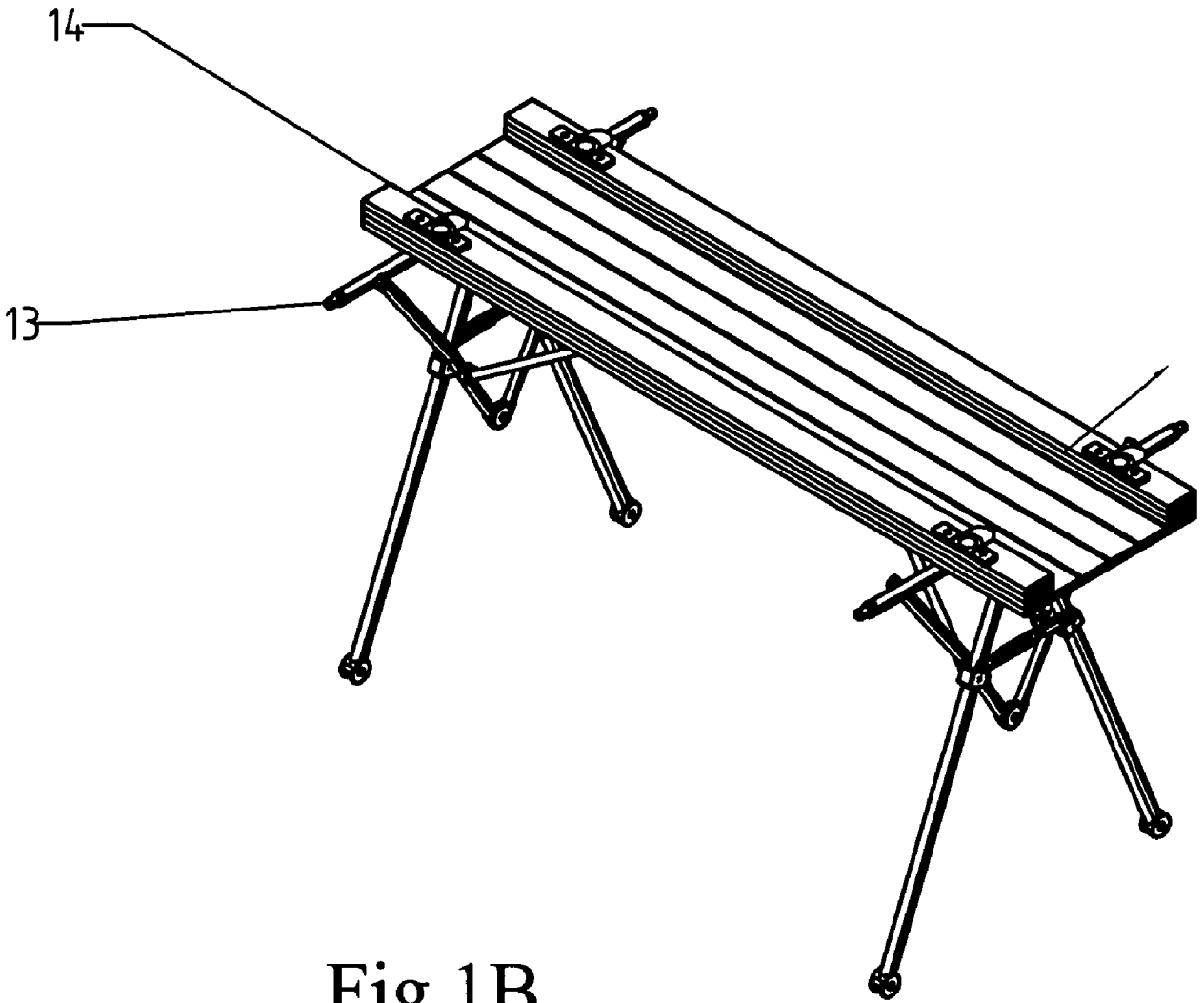
FIG. 1B is a structural view of the conjoined folding table according to one embodiment of this invention when the table plane is separated from both ends of the support frame.
Figure 9:
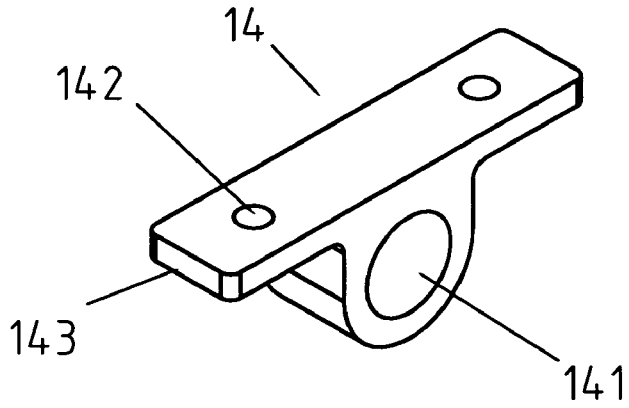
FIG. 9 is a view of the plane joint member of the conjoined folding table of this invention.

Referring to FIG. 1B, at both ends of the table plane battens 5 are provided four table plane joint members 14. Referring to FIG. 9, the table plane joint member 14 has a plane support board 143, on which is provided a connection hole 142 for fixing the table plane, and under the board 143 is provided a connection hole 141, which can be sleeved on the elastic fastener 132 of the sealing head 13 fixed on the plane support traverse tube 2, so that the table plane and the plane support traverse tube 2 are movably connected. When the table needs to be folded, the table plane joint member 14 may be pulled out with force from the elastic fastener 132 of the sealing head 13 fixed on the plane support traverse tube 2 to separate the table plane from the plane support traverse tube 2 for folding.

FIG. 10 is a view of slide block 8, having a slide hole 82 and a connection hole 81, with the slide hole sleeved on the support leg 6.

FIGS. 11*a*-11*e* are sequential views from the folded state to the use state of the conjoined folding table according to one embodiment of this invention. When the structure of FIG. 2 is used, as shown in FIGS. 11*a*-11*e*, when the support leg 6 is unfolded, the slide block 8 is caused to slide upward, and this makes the slide support rod 3 spread the plane support traverse tube 2 upward, and then the table is locked tight by engaging between the limiting protrusion 42 of the self-locking joint member 4 and the limiting groove 41.

If the structure of FIG. 3 is used, the support leg 6 is unfolded, and this causes the slide block 8 to slide upward, and makes the slide support rod 3 slide upward along the slide sleeve 23. The slide block 19 at the upper end of the slide support rod 3 slides outward along the plane support traverse tube 2 to the stopper 22 and is fixed, so that the entire support frame is unfolded. Meanwhile, stay bar 17, the slant support rod 9, and pull rods 16 form a plurality of stable triangle support structures, and then the table plane is unfolded. The plane joint member 14 is mounted on the elastic fastener 132 of the sealing head fixed at the end of the traverse rod, thus, the folding table spreads and stands stable for use. In folding, the plane joint member is pulled out from the elastic fastener of the sealing head fixed at the end of the traverse rod, meanwhile, the plane is folded together. The plane support tubes are folded downward and cause the slide block to slide, and the slide block makes the slide support rods, support leg stay bar, slant support rod and the pull rod fold into one body.

The embodiments shown and described herein are only some of the embodiments of this invention. Undoubtedly, this invention is not limited to the specific embodiments shown and described herein. It is to be understood that modifications and equivalent substitutions to the embodiments of this invention shown and described herein made by persons having ordinary skill in the art will fall within the scope of the appended claims.

The invention claimed is:

1. A conjoined folding table, comprising:

a table plane and plane support frames, wherein under the table plane are disposed two groups of identical plane support frames, each group of plane support frames comprising two support legs, two slide support rods, a plurality of slide blocks, two slant support rods, a rod joint member, two pull rods, a stay bar, two plane support traverse tubes, a pivotal member, and two U-shaped hinges, wherein the pivotal member has a pivotal member body and is disposed at upper portions of the two support legs, at a lower portion of the pivotal member body is provided a mount groove which is pivotally connected to the two support legs, at one side of the pivotal member body is provided a tube mount groove, at an upper portion of the pivotal member is provided a mount groove for one of the plane support traverse tubes, and at an upper portion of the tube mount groove of the pivotal member is provided a fixture, each support leg is provided with one of the slide blocks, and the two slide support rods are respectively connected to the two support legs via the slide blocks, an upper end of one of the slide support rods is movably hinged with one of the plane support traverse tubes, one end of one of the slant support rods is connected to one of the slide blocks via a U-shaped hinge, and the other end of one of the slant support rods is connected to one end of one of the pull rods via the rod joint member, at the other end of one of the pull rods is provided a plane fixing joint piece for fastening to the table plane, one end of the stay bar is movably connected to the rod joint member, and the other end of the stay bar is pivotally mounted in the tube mount groove of the pivotal member, one end of each of the two plane support traverse tubes is pivotally mounted in the mount groove for mounting the plane support traverse tubes, and the other end of each of the two plane support traverse tubes is provided with a sealing head which is equipped for fixing the table plane, wherein the rod joint member includes a joint member body having a tube connection groove, the slant support rods are pivotally mounted in the tube connection groove, a pull rod connection groove for pivotally connecting pull rods is provided at an opposite side of the tube connection groove, an upper end of the joint member body is provided with a stay bar connection protrusion for pivotally connecting the stay bar, and the two slant support rods, the stay bar, and the two pull rods in the plane support frame form a joint structure in three directions in a three-dimensional space.

2. The conjoined folding table according to claim 1, wherein said table plane is comprised of a plurality of battens joined together via linking ropes.

3. The conjoined folding table according to claim 1, wherein between the two support legs of each of said plane support frames is provided a self-locking joint member, which is hinged to one body by two self-locking joint pieces, wherein one side of said each self-locking joint piece is disposed with a limiting section protruding from a piece body, which has a limiting groove facing a hinge hole, the limiting groove being engaged with the limiting section protruding from the outside of the hinge hole of the self-locking joint piece, and wherein the other side of said self-locking joint piece is disposed with a mount hole for connecting to one of the support legs.

4. The conjoined folding table according to claim 3, wherein lower ends of said two slide support rods are rotatably connected via a rotary member.

5. The conjoined folding table according to claim 1, further including a table plane joint member having a plane support board, which is provided with a first connection hole, and under the plane support board a second connection hole is provided for one of the plane support traverse tubes.

6. The conjoined folding table according to claim 1, wherein one end of said sealing head has an antiskid goffer, and the other end of said sealing head is provided with an elastic fastener having an elastic bayonet.

7. The conjoined folding table according to claim 1, wherein said table plane is mounted and fixed on table plane joint members at both ends of the plane support traverse tubes, the fixture at the top of each pivotal member, and on an upper portion of the plane fixing joint piece, thus constituting a fixed connection with the table plane.

8. The conjoined folding table according to claim 1, wherein lower ends of said two slide support rods are rotatably connected via a rotary member.

9. The conjoined folding table according to claim 1, wherein one end of one of said slide support rods is connected to one of the support legs via one of the slide blocks, an other end of one of said slide support rods is connected to one of the plane support traverse tubes via one of the slide blocks and is provided with a cross support rod, one end of the cross support rod is sleeved on one of the slide support rods via one of the slide blocks, an other end of the cross support rod is movably connected to the one of the slide blocks, and middle and upper portions of the cross support rod are hinged to one of the support legs.

* * * * *